US006128395A

United States Patent [19]

De Vries

[11] Patent Number: 6,128,395

[45] Date of Patent: Oct. 3, 2000

[54] LOUDSPEAKER SYSTEM WITH CONTROLLED DIRECTIONAL SENSITIVITY

[75] Inventor: Gerard Hendrik Joseph De Vries, 's-Hertogenbosch, Netherlands

[73] Assignee: Duran B.V., Zaltbommel, Netherlands

[21] Appl. No.: 08/836,997

[22] PCT Filed: Nov. 8, 1995

[86] PCT No.: PCT/NL95/00384

§ 371 Date: May 7, 1997

§ 102(e) Date: May 7, 1997

[87] PCT Pub. No.: WO96/14723

PCT Pub. Date: May 17, 1996

[30] Foreign Application Priority Data

Nov. 8, 1994 [WO] WIPO ..... 9401860

[51] Int. Cl.[7] ..... H04R 25/00

[52] U.S. Cl. ..... 381/387; 381/182

[58] Field of Search ..... 381/20, 182, 63, 381/66, 82, 89, 387, 332

[56] References Cited

U.S. PATENT DOCUMENTS

| | | | |
|---|---|---|---|
| 4,219,880 | 8/1980 | Nichols | 364/718 |
| 4,807,217 | 2/1989 | Ide | 369/89 |
| 4,896,285 | 1/1990 | Ishikawa et al. | 364/724.01 |
| 5,222,084 | 6/1993 | Takahashi | 370/32.1 |
| 5,233,664 | 8/1993 | Yanagawa et al. | 381/89 |
| 5,459,790 | 10/1995 | Scofield et al. | 381/25 |

FOREIGN PATENT DOCUMENTS

| | | |
|---|---|---|
| 3506139 | 6/1986 | Germany . |
| 2273848 | 6/1994 | United Kingdom . |
| WO9401981 | 1/1994 | WIPO . |

*Primary Examiner*—Paul Loomis
*Assistant Examiner*—Dionne N. Harvey
*Attorney, Agent, or Firm*—Bachman & LaPointe, P.C.

[57] ABSTRACT

Loudspeaker system having various loudspeakers ($SP_i$, i=0, 1, 2, . . . , m) which are arranged in accordance with a predetermined pattern and have associated filters ($F_i$, i=0, 1, 2, . . . , m), which filters all receive an audio signal (AS) and are equipped to transmit output signals to the respective loudspeakers ($SP_i$) such that they, during operation, generate a sound pattern of a predetermined form, wherein the loudspeakers ($SP_i$) have a mutual spacing ($l_i$), which, insofar as physically possible, substantially corresponds to a logarithmic distribution, wherein the minimum spacing is determined by the physical dimensions of the loudspeakers used.

11 Claims, 4 Drawing Sheets

LOUDSPEAKER SYSTEM WITH CONTROLLED DIRECTIONAL SENSITIVITY

Figure 1A:
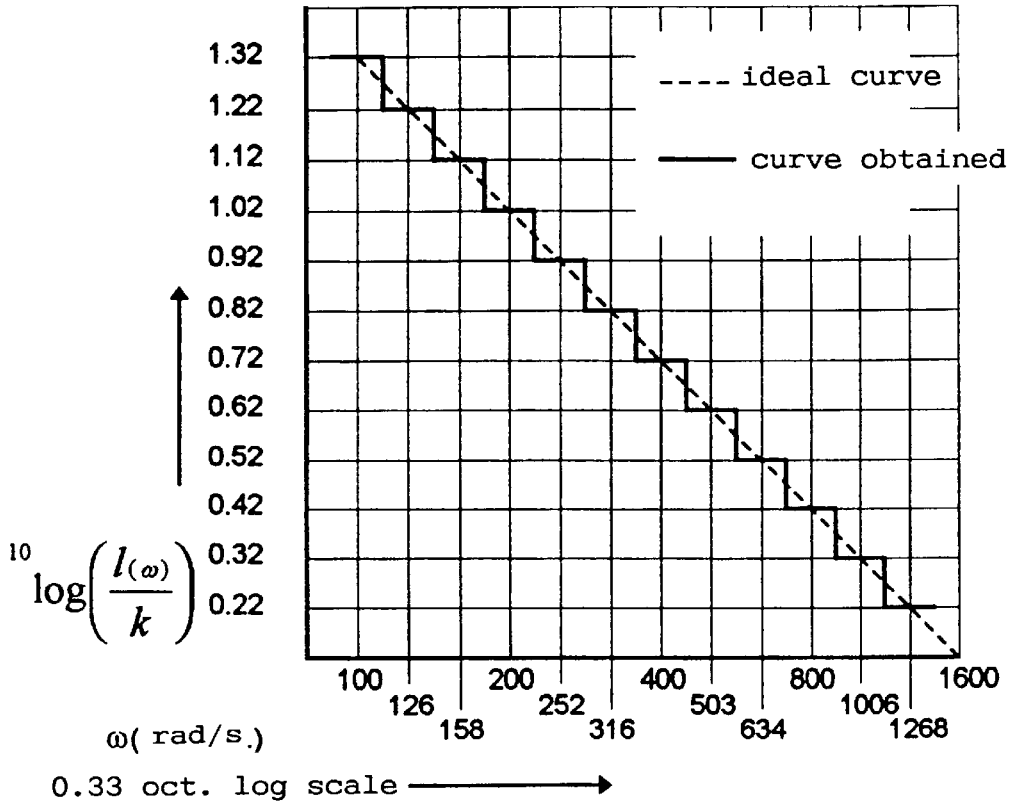

The invention relates to a loudspeaker system comprising various loudspeakers which are arranged in accordance with a predetermined pattern and have associated filters, which filters all receive an audio signal and are equipped to transmit output signals to the respective loudspeakers such that they, during operation, generate a sound pattern of a predetermined form.

A loudspeaker system of this type is disclosed in U.S. Pat. No. 5,233,664. The system described in said patent comprises m loudspeakers and N microphones, which are arranged predetermined distances away from the loudspeakers. Each loudspeaker receives an input signal from a separate series circuit of a digital filter and an amplifier. Each of said series circuits receives the same electrical input signal, which has to be converted into an acoustic signal. The digital filters have filter coefficients which are adjusted by a control unit, which receives, inter alia, output signals from the microphones. The loudspeakers are arranged in a predetermined manner. The objective is to be able to generate a predetermined acoustic pattern. During operation the control unit receives the output signals from the microphones and, on the basis of these, adjusts the filter coefficients of the digital filters until the predetermined acoustic pattern has been obtained. Loudspeakers in a linear array, in a matrix form and in a honeycomb structure are described in the embodiments.

The directional sensitivity of the known loudspeaker system can be controlled up to about 1400 Hz for the embodiments with a linear array and a matrix arrangement. An upper limit of about 1800 Hz is cited for the honeycomb structure. This upper limit is inadequate for many audio applications and it would be desirable to provide a loudspeaker system which can control the directional sensitivity up to frequencies of about 10 kHz.

In J. van der Werff, "Design and Implementation of a Sound Column with Exceptional Properties", 96th Convention of the AES (Audio Engineering Society), Feb. 26–Mar. 1, 1994, Amsterdam, an analogue loudspeaker system is described in which the individual loudspeakers are arranged at non-equidistant spacings along a straight line. The gaps between the individual loudspeakers are calculated on the basis of the criterion of maintaining the side lobes of the acoustic pattern transmitted during operation so as to be at a suitably low level. The density of the number of loudspeakers per unit length is greater in the vicinity of the acoustic centre than at a distance away from this.

The primary objective of the present invention is to provide a loudspeaker system which has a controlled directional sensitivity over as wide a frequency range as possible.

A further objective of the invention is to provide a loudspeaker system wherein the maximum deviation of the directional sensitivity is as far as possible constant over the envisaged frequency range.

To this end, the invention provides a loudspeaker system according to the type described above, characterised in that the loudspeakers have a mutual spacing, which, insofar as physically possible, substantially corresponds to a logarithmic distribution, wherein the minimum spacing is determined by the physical dimensions of the loudspeakers used. By not making the mutual spacing of the loudspeakers equidistant but adapting it to the frequency requirements, it is possible to control the directional sensitivity up to, certainly, 8 kHz. The side lobe level is reduced at the same time. By choosing a logarithmic distribution, the maximum deviation of the directional sensitivity over the envisaged frequency range is kept as constant as possible and spatial aliasing at higher frequencies is counteracted. Primarily it is not so much the form of the sound pattern as the transmission angle which is controlled.

There are various possibilities for the arrangements. For instance, the loudspeakers can be arranged along a straight line, in which case the said distribution extends from a central loudspeaker in one direction along said line.

As an alternative, the loudspeakers can be arranged along two straight line sections, in which case the said distribution extends from a central loudspeaker in two directions along the two line sections, which central loudspeaker is located at an intersection of the two line sections.

The two line sections can be on a straight line.

As a further alternative, the loudspeakers can be arranged on two lines which cross one another or can be arranged in the form of a matrix.

Preferably, the loudspeakers are identical.

The loudspeakers can be arranged in various rows, each of which is optimised for a specific, predetermined frequency band. The loudspeakers arranged in said rows can, for example, be of different dimensions and/or have a different logarithmic distribution.

The filters can be FIR filters or IIR filters.

Preferably, the filters are digital filters which have predetermined filter coefficients and are each connected in series with associated delay units having predetermined delay times, which filter coefficients and delay times are stored in a memory, for example an EPROM.

The audio signal preferably originates from an analogue/digital converter, which also has an input for receiving a background signal corresponding to the sound in the surroundings. Said analogue/digital converter can be provided with an output for connection to at least one dependent ancillary module.

Figure 1B:
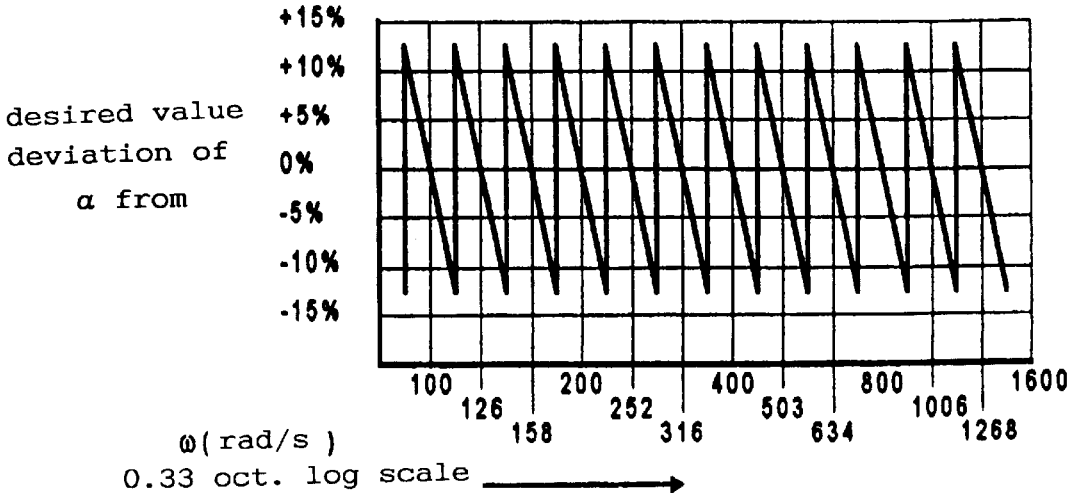
Figure 3:
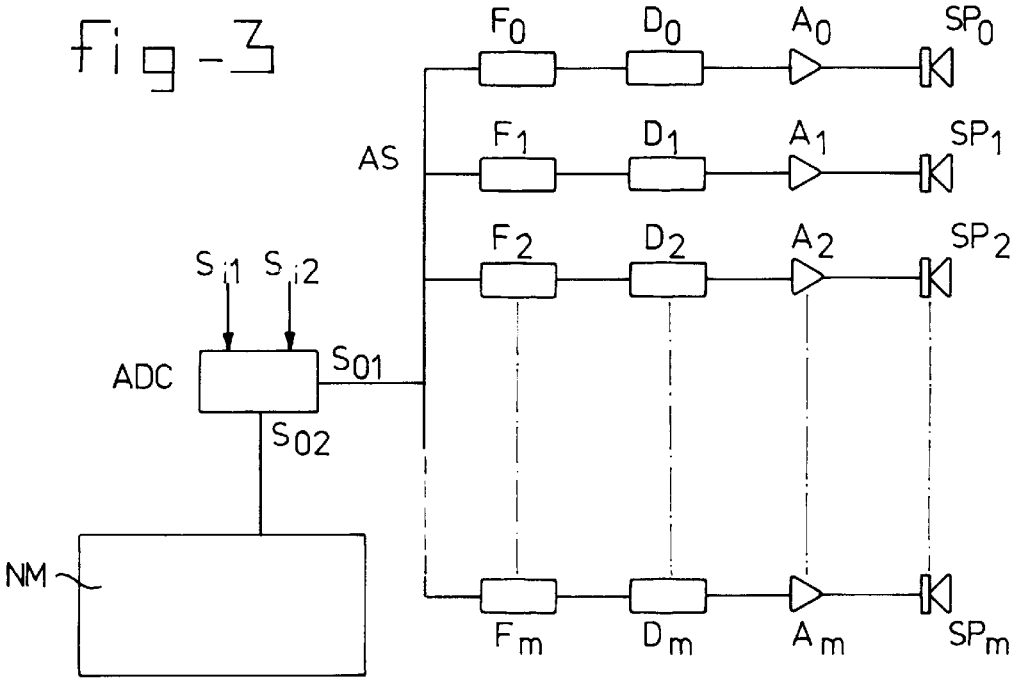
Figure 4:
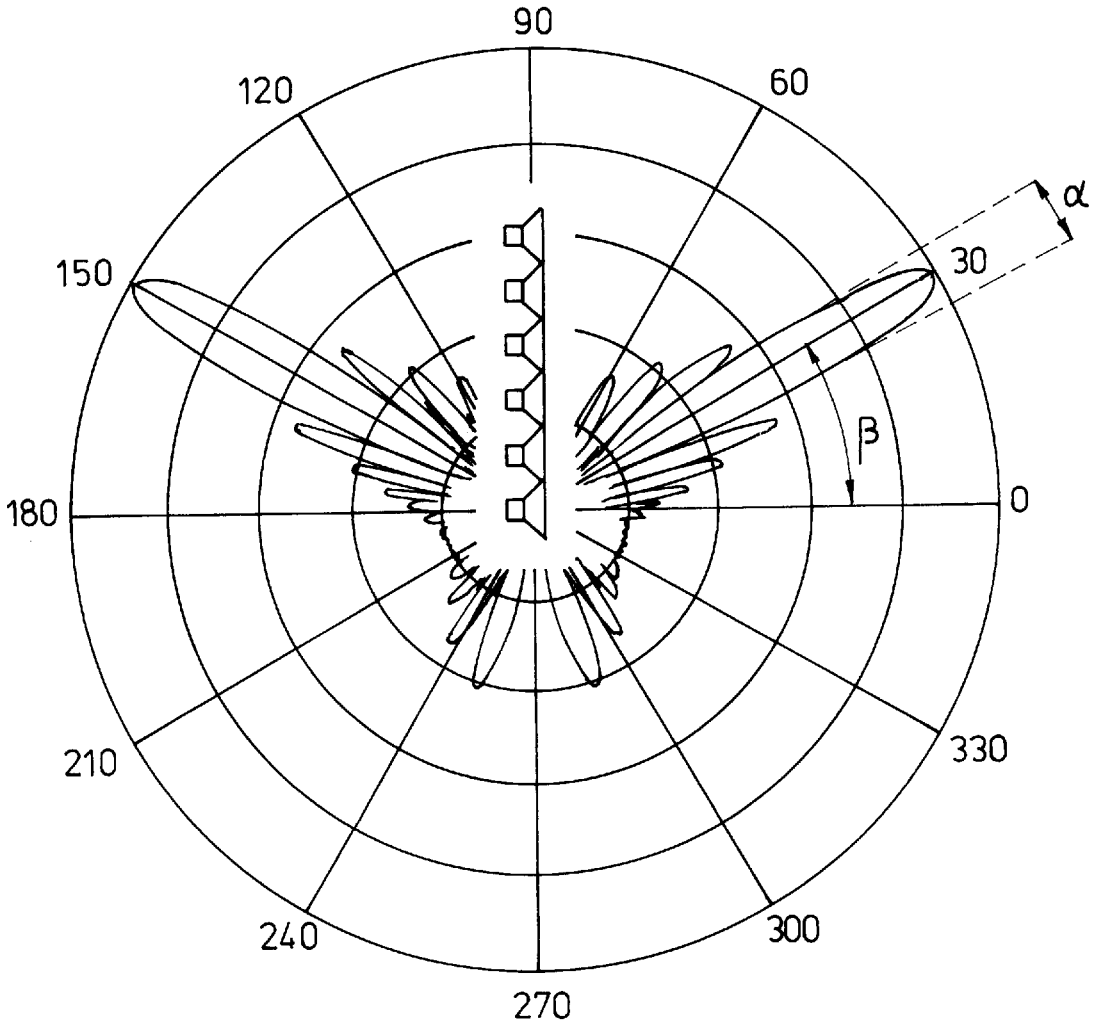

The invention will be explained in more detail below with reference to a few diagrammatic drawings, in which:

FIG. 1*a* shows an effective, normalised array length as a function of the angular frequency for a distribution of three loudspeakers per octave band;

FIG. 1*b* shows the deviation of the opening angle $\alpha$ as a function of the angular frequency for a distribution of three loudspeakers per octave band;

FIGS. 2*a* to 2*d* show various arrangements of loudspeakers in accordance with the present invention;

FIG. 3 shows a diagrammatic overview of an electronic circuit which can be used to control the loudspeakers; and FIG. 4 shows an example of an acoustic pattern.

The present description refers to an array of loudspeakers. Such an array can be one-dimensional (line array) or two-dimensional (plane).

If the transmitting portion for each frequency component in a sound signal which is reproduced is proportional to the wavelength of the frequency component concerned, the array is found to display frequency-independent behaviour. Two concepts are important for good understanding of the present invention: the opening angle and the transmission angle. The opening angle is, by definition, the angle through which a sound source can be turned such that the sound pressure does not fall by more than 6 dB with respect to the maximum value which is measured at a fixed point in a plane in which the sound source is located, and at a distance which is large compared with the physical dimensions of said sound source. Said angle is indicated by "$\alpha$" in FIG. 4, which figure will be discussed further below. The transmission angle is, by definition, the angle $\beta$ which the axis of symmetry of the transmission pattern makes with a plane perpendicular to the axis along which a one-dimensional array is arranged, or with a middle vertical line of the plane in which a two-dimensional array is arranged (FIG. 4). In the case where a two-dimensional array is used, two opening angles and two transmission angles can be defined for a transmission pattern.

The following relationship applies for the dimensions of the effective portion of a linear array having an infinite number of loudspeakers, as a function of the frequency:

$$l(\omega) = k \cdot \lambda = \frac{c_0 \cdot 2 \cdot \pi}{\omega} \tag{1}$$

where:

$l(\omega)$=the effective array size, $c_0$=the speed of sound (m/s)

k=a proportionality constant, which is a measure of the opening angle $\alpha$ $\omega$=angular frequency (rad/s)

The following rule of thumb can be used to calculate the proportionality constant k:

$$k = \frac{72^\circ}{\alpha} \tag{2}$$

where:

$\alpha$ is the desired opening angle in degrees.

This relationship for the proportionality constant k has an accuracy of more than 90% for k>1.

Because an array in practice does not consist of an infinite number of loudspeakers but is composed of a limited number of loudspeakers, the array size $l(\omega)$ is quantised. As can be seen from FIGS. 1*a* and 1*b*, this results in a limited resolution in the opening angle $\alpha$. FIG. 1*a* shows the effective array length (logarithmic) as a function of the angular frequency (logarithmic ⅓ octave) for a distribution of three loudspeakers per octave band. FIG. 1*b* shows the deviation of the opening angle $\alpha$ as a function of the angular frequency for a distribution of three loudspeakers per octave band. Of course, this is merely an example and the invention is not restricted to three loudspeakers per octave band.

The criterion taken for calculation of the spacing of loudspeakers is that the maximum deviation of the directional sensitivity must be kept as constant as possible over the envisaged frequency range. As will become apparent below, this can be achieved by providing the loudspeakers used, $SP_1$, $SP_2$, . . . , with a logarithmic arrangement with respect to a central loudspeaker $SP_0$. This also results in minimalisation of the deviation of the opening angle $\alpha$ and minimalisation of the number of loudspeakers required.

The frequency-dependent variation in a is inversely proportional to the number of loudspeakers per octave band and theoretically is 50% for a distribution of one loudspeaker per octave. Preferably, in practice use is made of at least two to three loudspeakers per octave.

If the array size $l(\omega)$ in a single dimension is quantised with the aid of n steps per octave band, the following relationship then applies for the array size:

$$l(i) = k \cdot \frac{c_0 \cdot 2 \cdot \pi}{\omega_{\min} \cdot 2^{\frac{i}{n}}} \quad \text{where} \quad 0 \le i \le n_{\max} - 1 \tag{3}$$

where:

$\omega_{min}$=the lowest reproducible angular frequency (radians per second) at which the opening angle $\alpha$ is still controlled;

n=number of loudspeakers per octave band;

$n_{max}$=the total number of discrete steps in a single dimension, depending on the desired frequency range.

For a value of i=0, this gives the maximum physical dimension of the array, which is dependent on $\omega_{min}$ and $k(\alpha)$.

Figure 2A:
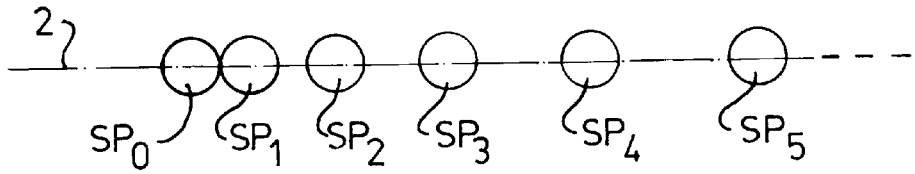

The loudspeaker positions depend on the physical configuration of the array. Said configuration can be asymmetrical or symmetrical. In the case of an asymmetrical configuration, the central loudspeaker $SP_0$ is located at one side of the array, as is shown in FIG. 2*a*. The above Equation 3 applies for the distance l(i) between the loudspeaker positions and the central loudspeaker $SP_0$, which corresponds to a logarithmic distribution. In order to produce such an array, $n_{max}$ loudspeakers are required in one dimension.

Figure 2B:
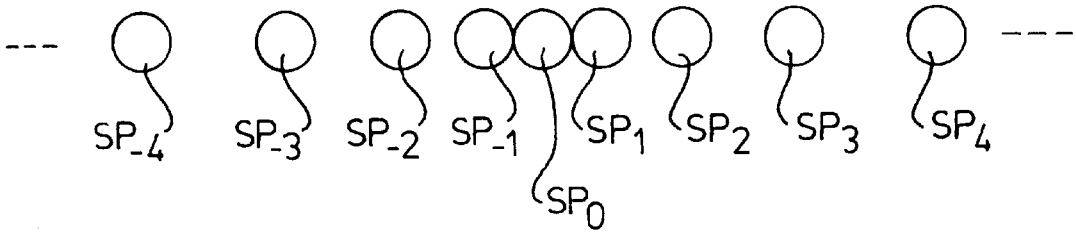

FIG. 2*b* shows a symmetrical arrangement of loudspeakers around a central loudspeaker $SP_0$, which is located in the middle. The above Equation 3 multiplied by a factor of ½ applies for loudspeakers $SP_1$, $SP_2$, $SP_3$, . . . , whilst Equation 3 multiplied by a factor of −½ applies for loudspeakers . . . $SP_{-3}$, $SP_{-2}$, $SP_{-1}$. For a symmetrical arrangement according to FIG. 2*b*, $2.n_{max}-1$ loudspeakers are needed. It is found that the symmetrical arrangement according to FIG. 2*b* gives a better suppression of the side lobe level than does the asymmetrical arrangement according to FIG. 2*a*.

In fact, FIG. 2*b* is a combination of 2 array configurations according to FIG. 2*a* with coincident central loudspeakers. These two separate loudspeaker arrays can also be located on two line sections, which do not lie in the extension of one another.

Figure 2C:
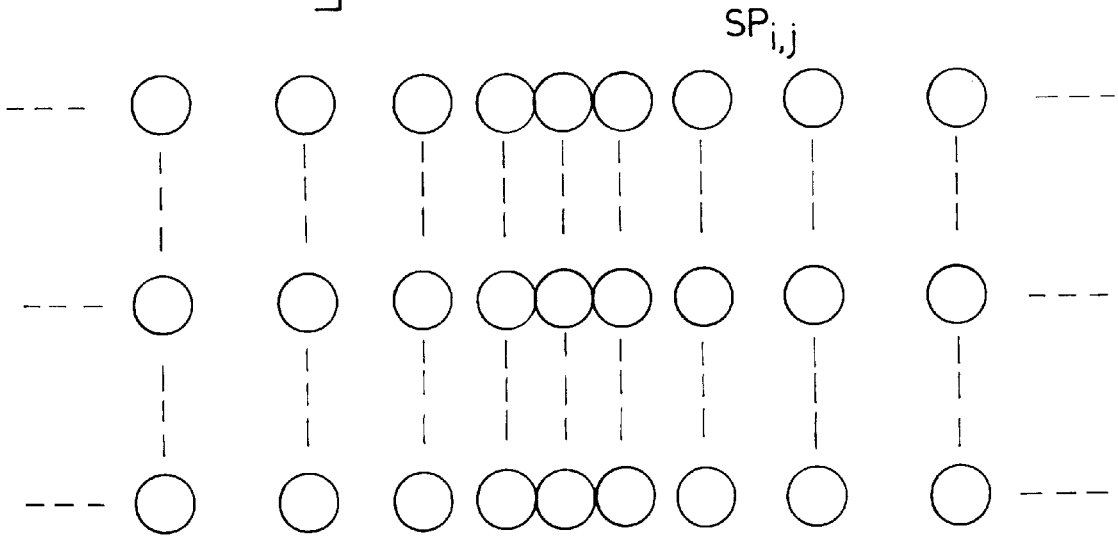

Instead of the configurations shown in FIGS. 2*a* and 2*b*, two-dimensional configurations are also possible. FIG. 2*c* shows a matrix arrangement of loudspeakers, in which various loudspeaker arrays according to FIG. 2*b* are arranged parallel to one another. $n_{max\ hor} \cdot n_{max\ vert}$ loudspeakers are present in an arrangement of this type. Here $n_{max\ hor}$ is the number of loudspeakers in the horizontal direction and $n_{max\ vert}$ is the number of loudspeakers in the vertical direction.

Figure 2D:
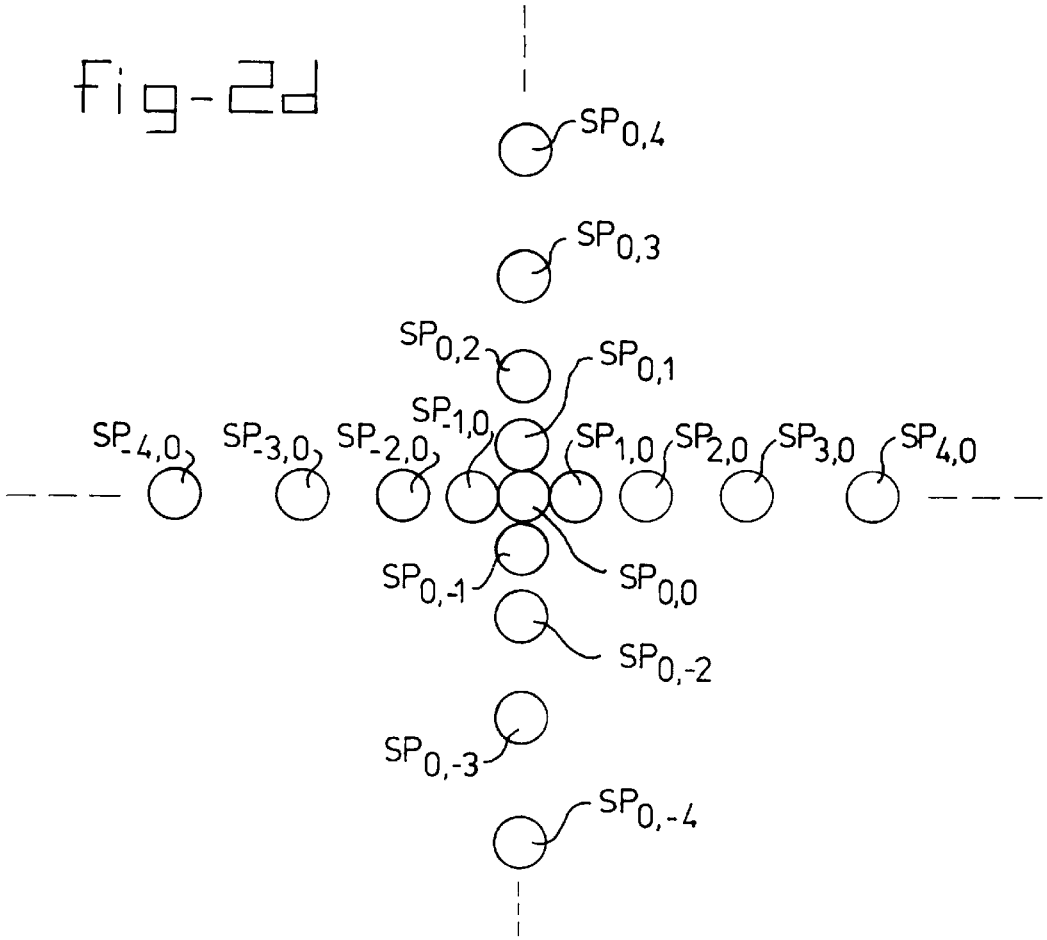

FIG. 2*d* shows a two-dimensional configuration with an arrangement in the form of a cross. FIG. 2*d* shows two loudspeaker arrays according to FIG. 2*b* which are arranged perpendicular to one another with a coincident central loudspeaker $SP_{0,0}.n_{max\ hor}+n_{max\ vert}-1$ loudspeakers are present in the arrangement according to FIG. 2.

Of course, arrangements along other and more lines crossing one another are also possible. The only proviso in the context of the present invention is that the various loudspeakers $SP_{i,j}$ are arranged in accordance with a logarithmic distribution, for example as defined by the above Equation 3.

In practice, the loudspeakers have a definitive physical size. This physical size determines the minimal possible spacing between the loudspeakers. Those loudspeakers which, in accordance with the above Equation 3, would have to be placed a distance apart which is smaller than the physical size permits are, in practice, placed in contact with one another. This leads to concessions with regard to the resolution in the frequency range concerned. Naturally, the concessions with regard to the resolution are as small as possible if the sizes of the loudspeakers are chosen to be as small as possible. However, smaller loudspeakers usually have poorer characteristics with regard to power and efficiency. Therefore, in practice, a compromise will always have to be made between the quality of the loudspeakers and the concessions in respect of the resolution.

Preferably, all loudspeakers must have the same transfer function. Therefore, all loudspeakers in the one-dimensional or two-dimensional array are preferably identical to one another.

It is, however, also possible to use various arrays arranged alongside one another which are provided with different loudspeakers, in which case the dimensions of the loudspeakers and their mutual positions in the various arrays are optimised for a specific limited frequency band. In that case no concessions have to be made in respect of the resolution and the power or the efficiency. Of course, this is at the expense of the number of loudspeakers required.

FIG. 3 shows a diagrammatic overview of a possible electrical circuit for controlling the loudspeakers. For ease, only the loudspeakers $SP_0$, $SP_1$, . . . , $SP_m$ and the associated electronics are indicated in the figure. Therefore, FIG. 3 corresponds to the loudspeaker array according to FIG. 2*a*. However, similar electronic circuits also apply for other loudspeaker arrays according to the invention, for example according to FIGS. 2*b*, 2*c* and 2*d*.

Each loudspeaker $SP_i$ receives an input signal from a series circuit comprising a filter $F_i$, a delay unit $D_i$ and an amplifier $A_i$. The filters $F_i$ are preferably digital filters of the FIR (Finite Impulse Response) type or of the IIR (Infinite Impulse Response) type. If IIR filters are used, they preferably have a Bessel characteristic. The coefficients of the filters $F_i$ are calculated beforehand and stored in a suitable memory, for example an EPROM. This preferably takes place during manufacture of the loudspeaker system. The filter coefficients of the filters $F_i$ are then no longer adjusted during operation, so that it is then possible to dispense with an electronic control unit which would be connected to the filters $F_i$ and the delay unit $D_i$ for adjusting the filter coefficients, or the delay times, during operation on the basis of the sound pattern recorded by microphones. However, use of such a feedback to a control unit (not shown here) and various microphones, as is disclosed in the abovementioned U.S. Pat. No. 5,233,664, is possible within the scope of the present invention.

The delay times for each of the delay units $D_i$ are preferably also calculated beforehand during manufacture and stored in a suitable chosen memory, for example in an EPROM. These delay times are then also no longer changed during operation.

Each of the filters $F_i$ receives an audio signal AS via a first output $S_{o1}$ of an analogue/digital converter ADC. The analogue/digital converter ADC receives a first analogue input signal $S_{i1}$, which has to be converted by the loudspeakers $SP_0$, $SP_1$, . . . , into a sound pattern with a predetermined directional sensitivity.

Preferably, the analogue/digital converter ADC is also connected to a measurement circuit which is not shown, which supplies a second input signal $S_{i2}$ which is a measure for the noise in the surroundings. Depending of the level of the noise in the surroundings (that is to say the amplitude of the input signal $S_{i2}$), the analogue/digital converter ADC automatically adapts its output signal $S_{o1}$ in such a way that the sound produced by the loudspeakers $SP_0$, $SP_1$, . . . , is automatically adjusted to the noise in the surroundings.

The analogue/digital converter ADC can also be connected to one or more ancillary modules NM, one of which is shown diagrammatically in FIG. 3. The analogue/digital converter ADC controls said one or more ancillary modules NM via a second output signal $S_{o2}$.

The number of loudspeakers can be expanded by the use of one or more such ancillary modules NM. To this end, the one or more ancillary modules NM then consist(s) of one or more of the loudspeaker configurations according to FIGS. 2*a*, 2*b*, 2*c* and/or 2*d* or variants thereof, each of the loudspeakers being provided with a series circuit comprising a (digital) filter, a delay unit and an amplifier, as is indicated in the upper part of FIG. 3 for the loudspeakers $SP_o$, $SP_1$, . . . .

It is, however, also possible to equip the ancillary module NM only with various parallel series circuits comprising a (digital) filter, a delay unit and an amplifier, which series circuits are then connected to the loudspeakers $SP_0$, $SP_1$, . . . of the main module according to FIG. 3. With an arrangement of this type, various transmission patterns with different directional sensitivity can be generated with a single loudspeaker array.

It will be clear to those skilled in the art that the (digital) filters $F_1$, the delay units $D_i$ and the amplifiers $A_i$ do not have to be physically separate components, but that they can be realised by means of one or more digital signal processors.

Resolution over a period of about 10 microseconds is found to be a suitable value in order to achieve adequate resolution in respect of the transmission angle β. Good coherence of the loudspeakers, even at higher frequencies, is also ensured by this means. This is achieved by using a sampling frequency of 48 kHz for the analogue/digital conversion in the analogue/digital converter ADC and using the same sampling frequency for calculation of the filter coefficients as well. The delay units $D_i$ are fed at a sampling frequency of 96 kHz by doubling the first-mentioned sampling frequency. This gives a resolution of 10.4 microseconds. Of course, other sampling frequencies are also possible within the scope of the invention.

A loudspeaker array designed in accordance with the guidelines given above has a well defined directional sensitivity which is substantially frequency-independent over a wide frequency range, that is to say up to at least a value of 8 kHz. The directional sensitivity is found to be very good in practice.

It is also possible to design a loudspeaker array in accordance with the guidelines given above with which the transmission pattern is not perpendicular to the axis along which the loudspeaker array is located (or the plane in which said array is located). The opening angle α can be selected by making a suitable choice for the filter coefficients, whilst any desired transmission angle β can be obtained by adjustment of the delay times. In this way, a sound pattern can be directed electronically. When a one-dimensional loudspeaker array is used, the transmission pattern is rotationally symmetrical with respect to the array axis 2. When a two-dimensional loudspeaker array is used, the transmission pattern is symmetrical according to a mirror image about the array plane. This symmetry can advantageously be used in situations in which the directional sensitivity of the sound which is generated at the rear of the loudspeaker array also has to be controlled.

Finally, FIG. 4 shows an example of a (simulated) polar diagram to illustrate a possible result of a loudspeaker array designed according to the invention. The opening angle α shown in this figure is approximately 10°, whilst the transmission angle β is approximately 30°. The arrangement of the loudspeaker array which generates the pattern shown is likewise shown diagrammatically. For the sake of convenience, the logarithmic distribution has been dispensed with in this diagram.

What is claimed is:

1. Loudspeaker system comprising a first set of at least three loudspeakers ($SP_0$, $SP_1$, . . . ), which are arranged along a first straight line in accordance with a predetermined pattern, each loudspeaker having an associated filter ($F_0$, $F_1$ . . . ), which filters all receive an audio signal (AS) and are equipped to transmit output signals to the respective loudspeakers ($SP_0$, $SP_1$ . . . ) such that they, during operation, generate a sound pattern of a predetermined form, characterized in that the at least three loudspeakers ($SP_0$, $SP_1$ . . . ) of said first set are arranged on locations (l(i)) relative to an origin, said locations being defined by the following equation:

$$l(i) = k \cdot \frac{c_0 \cdot 2 \cdot \pi}{\omega_{\min} \cdot 2^{\frac{i}{n}}} \quad \text{where } 0 \le i \le n_{\max} - 1$$

where:

l(i)=locations on which a loudspeaker is arranged; the origin is the location for which $i \rightarrow \infty$;

$i=0, 1, \ldots, n_{max}-1$;

$c_0$=the speed of sound (m/s);

k=a proportionality constant, which is a measure of opening angle $\alpha$;

n=number of loudspeakers per octave band;

$n_{max}$=the total number of discrete steps in a single dimension, depending on the desired frequency range;

$\omega_{min}$=the lowest reproducible angular frequency (radians per second) at which the opening angle $\alpha$ is still controlled;

and wherein when in accordance with said equation loudspeakers would have to be placed a distance apart which is smaller than the physical size permits they are placed in contact with one another.

2. Loudspeaker system according to claim 1, characterized by a second set of at least three loudspeakers ($SP_{-1}$, $SP_{-2}$ . . . ) arranged along a second straight line in accordance with an equal equation as the first set of at least three loudspeakers, origins of said first and second sets being coincident.

3. Loudspeaker system according to claim 2, characterized in that the first and second straight lines coincide and that the first set of loudspeakers ($SP_0$, $SP_1$, . . . ) is disposed on one side of said origin and the second set of loudspeakers ($SP_{-1}$, $SP_{-2}$, . . . ) is disposed on the other side of said origin on said straight line.

4. Loudspeaker system according to claim 1, characterized by a plurality of further sets of at least three loudspeakers, each further set arranged along a further straight line in accordance with an equal equation as the first set of at least three loudspeakers, any of said further straight lines being parallel to said first straight line.

5. Loudspeaker system according to claim 1, characterized in that the loudspeakers are identical.

6. Loudspeaker system according to claim 4, characterized in that the further sets of at least three loudspeakers have been optimized for a specific, predetermined frequency band.

7. Loudspeaker system according to claim 1, characterized in that the filters ($F_0$, $F_1$, . . . ) are either FIR filters or IIR filters.

8. Loudspeaker system according to claim 1, characterized in that the filers are digital filters ($F_0$, $F_1$, . . . ) which have predetermined filter coefficients and are each connected in series with associated delay units ($D_0$, $D_1$, . . . ) having predetermined delay times, which filter coefficients and delay times are stored in a memory, for example an EPROM.

9. Loudspeaker system according to claim 1, characterized in that the audio signal (AS) originates from an analogue/digital converter (ADC), which also has an input for receiving a background signal ($S_{i2}$) corresponding to the sound in the surroundings.

10. Loudspeaker system according to claim 9, characterized in that the analogue/digital converter has a further output for connection to at least one dependent ancillary module comprising various further loudspeakers which are arranged in accordance with a predetermined further pattern and have associated further filters, which filters all receive said audio signal and are equipped to transmit further output signals to the respective further loudspeakers such that they, during operation, generate a further sound pattern of a further predetermined form, wherein the further loudspeakers have a mutual further spacing, which, insofar as physically possible, substantially corresponds to a logarithmic distribution, wherein the minimum spacing is determined by the physical dimensions of the loudspeakers used.

11. Loudspeaker system according to claim 9, characterized in that the analogue/digital converter has a further output for connection to at least one dependent ancillary module comprising various parallel series circuits, each series circuit comprising a filter, a delay unit and an amplifier, and each series circuit being connected to a distinct one of said loudspeakers.

* * * * *